US006644755B1

(12) United States Patent
Kammerer

(10) Patent No.: US 6,644,755 B1
(45) Date of Patent: Nov. 11, 2003

(54) FIXTURE FOR A ROUND SHANK CHISEL HAVING A WEARING PROTECTION DISK

(75) Inventor: Karl Kammerer, Fourn-Winzeln (DE)

(73) Assignee: Betek Bergbau- und Hartmetalltechnik Karl-Heinz Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/857,760

(22) PCT Filed: Nov. 9, 1999

(86) PCT No.: PCT/EP99/08596

§ 371 (c)(1),
(2), (4) Date: Jun. 8, 2001

(87) PCT Pub. No.: WO00/34625

PCT Pub. Date: Jun. 15, 2000

(30) Foreign Application Priority Data

Dec. 10, 1998 (DE) ..... 198 56 916

(51) Int. Cl.[7] ..... E21C 35/197
(52) U.S. Cl. ..... 299/104; 299/106; 299/110
(58) Field of Search ..... 299/102–107, 299/110–111

(56) References Cited

U.S. PATENT DOCUMENTS 4,489,986 A * 12/1984 Dziak ..... 299/104
4,561,698 A * 12/1985 Beebe ..... 299/104
5,931,542 A * 8/1999 Britzke et al. ..... 299/104
6,113,195 A * 9/2000 Mercier et al. ..... 299/104
6,508,516 B1 * 1/2003 Kammerer ..... 299/104

FOREIGN PATENT DOCUMENTS

| | | | |
|---|---|---|---|
| DE | 34 08 209 | | 9/1984 |
| DE | 9213528 | * | 2/1993 |
| DE | 29623215 | * | 2/1998 |
| GB | 2109438 | * | 6/1983 |

* cited by examiner

*Primary Examiner*—Heather Shackelford
*Assistant Examiner*—Sunil Singh
(74) *Attorney, Agent, or Firm*—Pauley Petersen & Erickson

(57) ABSTRACT

A fixture for attaching a round shank chisel to a road milling machine or the like. The round shank chisel has a chisel head and a chisel shank. With a bearing surface the chisel head rests upon a wearing protection disk which in turn rests on and is supported by a chisel holder. The chisel shank is accommodated by a location bore of the chisel holder. This invention prevents dirt from penetrating the area of the location bore of such a fixture and at the same time ensures that the free movability of the round shank chisel is not impaired. Thus, the chisel holder has a circumferential projection or a circumferential depression which extends along the location bore. Also, the wearing protection disk has a circumferential receiving groove or a circumferential shoulder and the projection or the depression of the chisel holder engages with the receiving groove or the depression of the wearing protection disk when the round shank chisel is assembled.

10 Claims, 2 Drawing Sheets

FIXTURE FOR A ROUND SHANK CHISEL HAVING A WEARING PROTECTION DISK

BACKGROUND OF THE INVENTION

1. Field of the Invention

A fastening for a round shank chisel on a road scraper or the like, wherein the round shank chisel has a chisel head and a chisel shank, the chisel head rests with a contact surface on a wear-protection disk, which is supported on a chisel holder, and the chisel shank is inserted into a receiver bore of the chisel holder.

2. Description of Related Art

Such a fastening is known from German Patent Reference DE 34 08 209 A1. With this fastening, the chisel shank of the round shank chisel is clampingly maintained in the receiver bore of the chisel holder with a clamping sleeve. The receiver bore is widened in the direction toward the chisel head. A ring element is positioned into this widening. The ring element has a circumferential collar, which projects past the top of the chisel holder. The collar is triangular in cross section. The collar engages a receiver groove, also triangular, of the chisel head. The chisel head is supported on the collar. With this arrangement dirt can be prevented from penetrating the area formed between the chisel head and the chisel holder and from subsequently entering the receiver bore. The ring element is made of a hard alloy. The round shank chisel rotates in the receiver bore when the tool is used. This causes considerable abrasion in the receiver groove of the chisel head. Because the ring element is made of a hard alloy, very strong abrasion results. The receiver groove is ground smooth after a short time of use, and the chisel head then is seated on the chisel holder which negatively affects the rotating ability of the round shank chisel that can cause the round shank chisel to seize.

SUMMARY OF THE INVENTION

It is one object of this invention to provide a fastening for a round shank chisel of the type described above but wherein the penetration of dirt into the receiver bore is dependably prevented, and wherein a rotating ability of the round shank chisel is not negatively affected during the entire service life of the round shank chisel.

This object is attained with a chisel holder that has a protrusion or a circumferential molding extending around the receiver bore. A wear-protection disk has a circumferential groove or a circumferential shoulder. In the assembled state of the round shank chisel, the protrusion or the molding of the chisel holder engages the receiver groove or the shoulder of the wear-protection disk.

A sort of a labyrinth is created between the contact surface of the chisel holder and the wear-protection disk by the receiver groove and the shoulder, which prevents the penetration of scraped-off material into the receiver bore. At the same time the rotating ability of the round shank chisel is not negatively affected, because the round shank chisel can be supported by its chisel head flat on the level wear-protection disk.

In a preferred embodiment of this invention, a protrusion is designed trapezoidal in cross section and has two lateral flanks, which extend at an angle with respect to a center longitudinal axis of the round shank chisel which, facing the wear-protection disk, are connected by a flat support section. The receiver groove of the wear-protection disk is also designed trapezoidal in cross section and rests with a contact surface on the support section. The support of the wear-protection disk over a large surface permits the transmission of high stresses occurring during work.

To align the wear-protection disk with the receiver bore, on its end area facing the chisel head, the receiver bore has a widening, against whose boundary face the wear-protection disk rests with a centering section.

In this case the centering section can be a part of the receiver groove, so that the effective contact surface is further enlarged for support and dissipation of introduced forces.

To simplify the mounting of the wear-protection disk on the round shank chisel, the chisel shank is inserted into a passage in the wear-protection disk, and on its area facing the chisel head, the passage has a widening. Alternatively or additionally, the free end of the chisel shank can also have a bevel, possibly with a phase.

A simple manufacture of the wear-protection disk can be achieved, for example, if it is produced as a punched and bent element from a disk-shaped blank, with an outer edge having a circumferential bent portion in the manner of a dish. The bent portion in a radially outwardly direction borders the receiving groove.

BRIEF DESCRIPTION OF THE DRAWINGS

This invention is explained in greater detail in view of two exemplary embodiments represented in the drawings, wherein.

DESCRIPTION OF PREFERRED EMBODIMENTS

Figure 1:
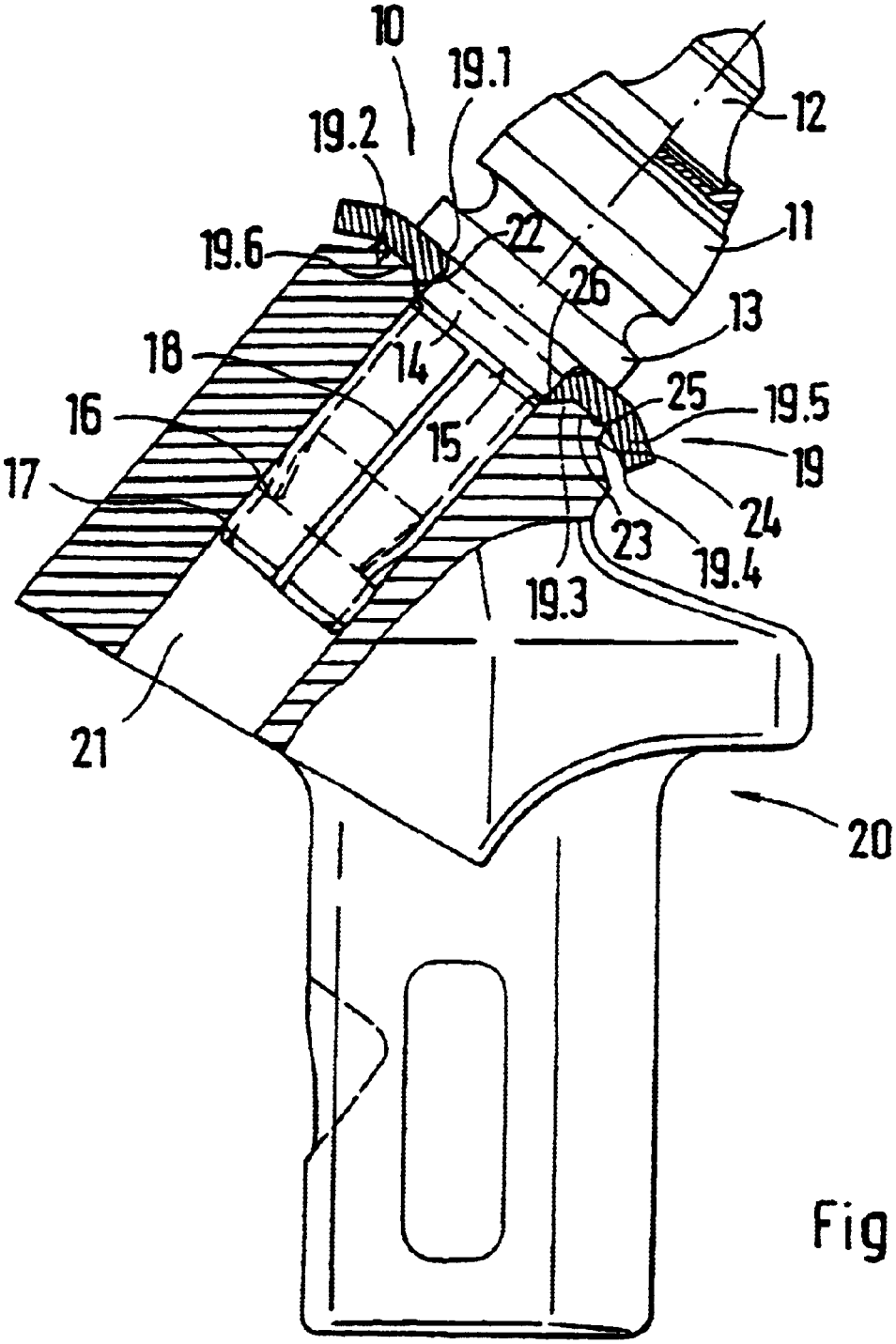
FIG. 1 shows a chisel holder with a chisel in a lateral view and in section.

FIG. 1 shows, in a lateral view and in section, a chisel holder 20 with a receiver bore 21, into which a round shank chisel 10 can be inserted. The round shank chisel 10 has a chisel head 11. The chisel head 11 has a chisel tip 12 which, as known, is made of a hard alloy. A chisel shank 14 is connected by means of a collar 13 to the chisel head 11 in an area facing away from the chisel tip 12. The chisel shank 14 has a circumferential groove, in which a clamping sleeve 17 is maintained. The clamping sleeve 17 has a longitudinal slit, which is defined by two longitudinal edges 18 extending in the direction of a center longitudinal axis of the round shank chisel 10. The chisel shank 14 is closed by a shoulder 16 at the end. A wear-protection disk 19 is pulled on the clamping sleeve 17. The wear-protection disk 19 has a through-bore for this purpose. The interior diameter of the through-bore is of such a size that the clamping sleeve 17 is held under prestress in the receiver groove 15. In this prestressed state the exterior diameter of the clamping sleeve 17 is dimensioned so that the round shank chisel 10 can be inserted into the receiver bore 21 with little effort. Initially the insertion movement of the round shank chisel 10 into the receiver bore 21 is limited by the wear-protection disk 19 touching the chisel holder 20.

In its area facing the chisel holder 20, the wear-protection disk 19 has a circumferential receiver groove 19.6 which is trapezoidal in cross section and is laterally bordered by two flanks, which are connected by means of a contact face 19.2. In this case the contact face 19.2 is arranged vertically with respect to the center longitudinal axis of the round shank chisel 10. The lateral flank facing the receiver bore 21 is used as a centering section 19.3. The centering section 19.3 engages with a widening, which adjoins the end of the receiver bore 21 of the chisel holder 20 and there forms a support flank 26. The centering section 19.3 rests on this support flank 26. The wear-protection disk 19 has a bent portion 19.5 at its outer edge. Here, the bent portion 19.5 is bent off in the direction toward the chisel holder 20.

A bead-like protrusion 23 projects from the chisel holder 20 in the direction toward the chisel head 11. The protrusion 23 is trapezoidal in cross section and is bordered by the inclined support flank 26 and an also inclined lateral flank 24. The lateral flank 24 is connected by means of a flat support section 25 with the support flank 26. The support section 25 extends at right angles with respect to the center longitudinal axis of the round shank chisel 10.

As mentioned above, the round shank chisel 10 can be inserted into the receiver bore 21 with little effort, until the wear-protection disk 19 touches the chisel holder 20. Thereafter, the wear-protection disk 19 can be displaced in the direction toward the chisel head 11 by a hammer blow on the chisel tip 12, wherein the chisel shank 14 simultaneously penetrates further into the receiver bore 21. Once the wear-protection disk 19 moves beyond the clamping sleeve 17, the clamping sleeve 17 snaps open radially, so that the two longitudinal edges 18 move apart. The clamping sleeve 17 is thus clamped in the receiver bore 21. In this assembled position, the collar 13 of the chisel head 11 rests flat on the wear-protection disk 19. The protrusion 23 of the chisel holder 20 engages the receiver groove 19.6 of the wear-protection disk 19. At the same time the wear-protection disk 19 rests against the support flank 26 of the widening 22 by means of its centering section 19.3.

Figure 2:
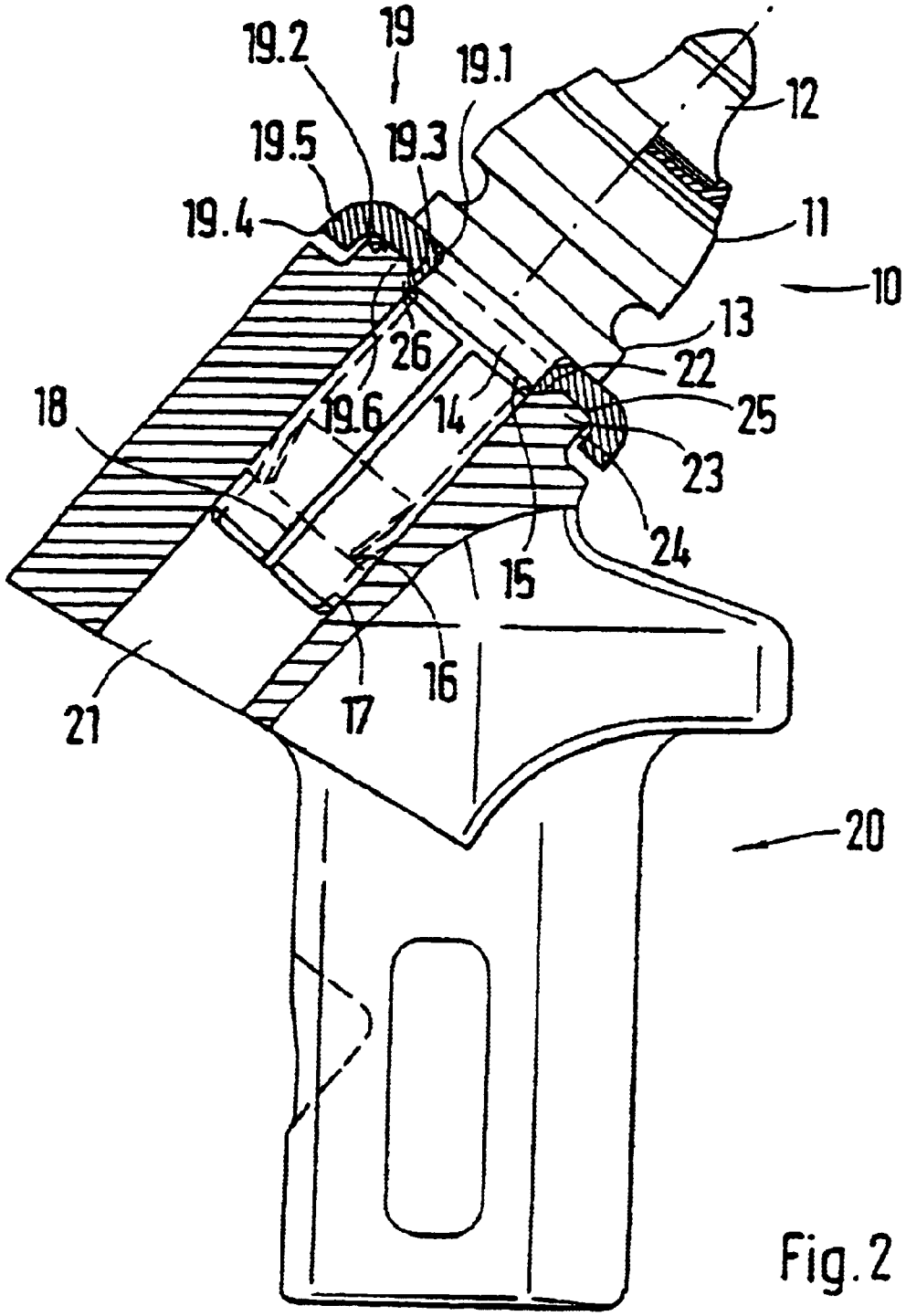
FIG. 2 shows a second embodiment of a chisel in a lateral view and in section.

The embodiment variation of a chisel holder 20 shown in FIG. 2 essentially corresponds to the one shown in FIG. 1. However, the lateral flank 24 of the chisel holder 20 extends in the direction toward the center longitudinal axis of the receiver bore 21. The bent portion 19.5 of the wear-protection disk 19 is also bent off so that it is parallel with and at a small distance from the lateral flank 24. A sort of a labyrinth is formed by this design, which prevents the entry of dirt.

What is claimed is:

1. In a fastening for a round shank chisel on a road scraper device, wherein the round shank chisel has a chisel head and a chisel shank, the chisel head rests with a contact surface on a wear-protection disk which rests on a chisel holder and is supported on the chisel holder, and the chisel shank is inserted into a receiver bore of the chisel holder, the improvement comprising:

the chisel holder (20) having an inclined support flank (26) extending around the receiver bore (21) and a support section (25) angled with respect to the support flank (26);

the wear-protection disk (19) having an outer edge including a circumferential bent portion (19.5);

the wear-protection disk (19) having a centering flank (19.3) facing the receiver bore (21) and having a contact face (19.2), the centering flank (19.3) angled with respect to the contact face (19.2) and forming a circumferential groove (19.6); and in an assembled state of the round shank chisel (10) within the receiver bore (21), the support flank (26) contacting the centering flank (19.3) and the support section (25) contacting the contact face (19.2).

2. In the fastening in accordance with claim 1, wherein a protrusion (23) is partially formed by the support section (25) and the support flank (26), the protrusion (23) is trapezoidal in cross section and the circumferential groove (19.6) is trapezoidal in cross section, and the protrusion (23) engages within the circumferential groove (19.6).

3. In the fastening in accordance with claim 2, wherein on an end area facing the chisel head (11) the receiver bore (21) has a widening (22).

4. In the fastening in accordance with claim 3, wherein the centering flank (19.3) is a part of the wear-protection disk (19).

5. In the fastening in accordance with claim 4, wherein the chisel shank (14) is inserted into a passage (19.1) of the wear-protection disk (19), and on an area facing the chisel head (11) the passage (19.1) has a second widening.

6. In the fastening in accordance with claim 5, wherein the wear-protection disk (19) is a punched and bent element from a disk-shaped blank, and has an outer edge with a circumferential bent portion (19.5) in a dish shape, and the bent portion (19.5) radially outwardly borders the circumferential groove (19.6).

7. In the fastening in accordance with claim 1, wherein on an end area facing the chisel head (11) the receiver bore (21) has a widening (22).

8. In the fastening in accordance with claim 7, wherein the centering flank (19.3) is a part of the wear-protection disk (19).

9. In the fastening in accordance with claim 1, wherein the chisel shank (14) is inserted into a passage (19.1) of the wear-protection disk (19), and on an area facing the chisel head (11) the passage (19.1) has a widening.

10. In the fastening in accordance with claim 1, wherein the wear-protection disk (19) is a punched and bent element from a disk-shaped blank, and has an outer edge with a circumferential bent portion (19.5) in a dish shape, and the bent portion (19.5) radially outwardly borders the circumferential groove (19.6).

* * * * *